US008206271B2

(12) United States Patent
Chu

(10) Patent No.: US 8,206,271 B2
(45) Date of Patent: Jun. 26, 2012

(54) CYCLICAL SKATING MOTION EXERCISE MACHINE

(75) Inventor: Yong S. Chu, Glendale, CA (US)

(73) Assignee: FitnessBotics, Inc.

( * ) Notice: Subject to any disclaimer, the term of this patent is extended or adjusted under 35 U.S.C. 154(b) by 0 days.

(21) Appl. No.: 13/032,421

(22) Filed: Feb. 22, 2011

(65) Prior Publication Data

US 2011/0143884 A1 Jun. 16, 2011

Related U.S. Application Data

(63) Continuation-in-part of application No. 12/383,185, filed on Mar. 20, 2009, now abandoned.

(60) Provisional application No. 61/070,238, filed on Mar. 20, 2008.

(51) Int. Cl.
*A63B 22/06* (2006.01)
*A63B 22/00* (2006.01)

(52) U.S. Cl. ..... 482/52; 482/57; 482/70

(58) Field of Classification Search ..... 482/51, 482/52, 53, 57, 62, 70, 71, 79, 90; 434/247, 434/255

See application file for complete search history.

(56) References Cited

U.S. PATENT DOCUMENTS

| | | | | | |
|---|---|---|---|---|---|
| 3,756,595 | A * | 9/1973 | Hague | 482/51 |
| 5,148,800 | A * | 9/1992 | Pecheux | 601/29 |
| 5,284,460 | A * | 2/1994 | Miller et al. | 482/51 |
| 5,391,130 | A * | 2/1995 | Green et al. | 482/71 |
| 5,536,225 | A * | 7/1996 | Neuberg et al. | 482/71 |
| 6,231,484 | B1 * | 5/2001 | Gordon | 482/71 |
| 6,234,935 | B1 * | 5/2001 | Chu | 482/51 |
| 6,849,032 | B2 * | 2/2005 | Chu | 482/51 |
| 7,402,126 | B2 * | 7/2008 | Chang | 482/52 |
| 7,455,623 | B2 * | 11/2008 | Wang | 482/52 |
| 7,510,510 | B2 * | 3/2009 | Chen et al. | 482/52 |
| 7,513,854 | B1 * | 4/2009 | Stearns et al. | 482/52 |
| 2004/0053753 | A1 * | 3/2004 | Galvez Campos | 482/70 |
| 2009/0239713 | A1 * | 9/2009 | Chu | 482/51 |

* cited by examiner

*Primary Examiner* — Loan Thanh
*Assistant Examiner* — Daniel F Roland
(74) *Attorney, Agent, or Firm* — Clement Cheng

(57) ABSTRACT

A cyclical skating motion exercise machine has a base frame assembly. A first pedal arm mounted on a first pedal axle, wherein the first pedal axle is substantially vertical. A first link assembly mounted to the first pedal arm at a first pedal joint. The first pedal joint provides motion between the first link assembly and the first pedal arm. A first pedal mounted to the first pedal arm for supporting a user's foot. A second pedal arm is mounted on a second pedal axle, wherein the second pedal axle is substantially vertical. A crank assembly has a first link assembly is mounted to the a crank assembly, and the crank assembly has rotational inertia is substantially orthogonally to the first pedal axle.

13 Claims, 9 Drawing Sheets

CYCLICAL SKATING MOTION EXERCISE MACHINE

This application is a continuation in part divisional application of inventor Yong Chu's Cyclical Skating Motion Exercise Machine application filed Mar. 20, 2009 now abandoned having Ser. No. 12/383,185, the disclosure of which is incorporated herein by reference. The parent application is in turn entitled to the benefit of Provisional Patent Application Ser. No. 61/070,238, filed Mar. 20, 2008.

FIELD OF THE INVENTION

This invention relates generally to an exercise apparatus that simulates a ski or skating motion for training a user the coordination and building body muscles.

DISCUSSION OF RELATED ART

Many ski or skating stationary exercise machines have been introduced in the field of the art with each machine having advantages and disadvantages compared to other machines. However, none of the related prior arts show a simple way to symmetrically simulate a ski or skating motion using a single crank axle linked with pedal assemblies that are based on arc motions or pivot motions for an effective use of an inertial component such as a flywheel in the system. Symmetrical ski or skating motion means that the curve of the speed of pedals moving from one side to the other side at angular positions of the pedals is mirror-imaged with the pedals moving in the opposite direction when the crank assembly, linked with the pedals, is at a set rotational speed and rotational direction. U.S. Pat. No. 5,284,460 to Miller discloses a skate training apparatus with a flywheel connected with the pedals using a flexible line such as chain links, but the flywheel has to change its rotational direction whenever the user changes the direction of the side motion, that doesn't create the smooth inertial effect with the direction change in motion. U.S. Pat. No. 6,234,935 to Chu discloses a skating exercise machine with different embodiments showing axes of crank assembly and axes of pedal assemblies being parallel or near parallel, and the crank assembly rotates in a single initial direction throughout a workout routine when the workout is not interrupted. However, the embodiments have two crank axles and two separate crank arms making the skating machine complicated and costly to build. U.S. Pat. No. 6,849,032 to Chu teaches a simplified skating exercise machine with a single crank with its axle near parallel to the axes of the pedal assemblies, however the embodiments of the art offers non-symmetrical ski or skating motion in which the speed of the pedals going one direction is different from the speed going in the opposite direction in a cycle at a given rotational speed and direction of the crank assembly.

SUMMARY OF THE INVENTION

The present invention teaches certain benefits in construction and use which give rise to the objectives described below. A primary objective of the present invention is to provide a system having advantages not taught by the prior art. Another objective is to provide such an apparatus that simulates a ski or skate motion on a stationary system for working out lower body of a user. Another objective is to provide such an apparatus that simulates a ski and skate motion on a stationary system for working out both lower and upper body of the user. Another objective is to provide such an apparatus that provides a crank system that is linked to pedal arm system so that the inertial force is directly used for a smooth operation of pedals and handles. Another objective is to provide such an apparatus that provides a single crank assembly with an orthogonal orientation of its rotational axis relative to the axes of the pedal assemblies that allows a symmetric movement or a near symmetric movement of the pedals. Another objective is to provide such an apparatus with a link assembly, that connects the crank assembly to the pedal assemblies, constructed to minimize a slack in axial direction for a smooth operation of the apparatus. Another objective is to provide such an apparatus with a flywheel system that help maintaining a long life of belts when it experiences a large inertial force and its frequent change of direction.

A cyclical skating motion exercise machine has a base frame assembly and a first pedal arm mounted on a first pedal axle. The first pedal axle is substantially vertical, and the first pedal axle is fixed to the base frame assembly. The first link assembly is mounted to the first pedal arm at a first pedal joint point. The first pedal joint point provides motion between the first link assembly and the first pedal arm. A first pedal is mounted to the first pedal arm for supporting a user's foot. A second pedal arm is mounted on a second pedal axle. The second pedal axle is substantially vertical, and the second pedal axle is fixed to the base frame assembly.

The first link assembly is mounted to the crank assembly. The crank assembly has rotational inertia substantially orthogonally to the first pedal axle. A first crank joint is continuously rotating about the first crank pivot in the same direction when the first crank joint is in use. A second crank joint is continuously rotating about the second crank pivot in the same direction when the second crank joint is in use.

Optionally, the machine may have a first handle assembly, and a second handle assembly. The first handle assembly is connected to the crank assembly by a third link assembly, and the second handle assembly is connected to the crank assembly by a fourth link assembly. A first handle grip is pivotally connected to the crank assembly via a first crank arm and a third link assembly.

The link assembly can be mounted to the first pedal arm and has a first cross joint, a second cross joint and an axle joint. A first handle grip can be pivotally connected to the crank assembly via a first crank arm and a third link assembly. The link assembly can be mounted to the first pedal arm which comprises a first cross joint, a second cross joint and an axle joint. A first pad link can be connected to a first pad secondary pivot and a second pad link can be connected to a second pad secondary pivot. The first pad link axle can be connected to the base frame assembly, and the second pad link axle can be connected to the base frame assembly. The crank assembly may have a belt, and the crank assembly could also have a bidirectional retainer system for removing slack from the belt.

The cyclical skating motion exercise machine could also have a link assembly mounted to the first pedal arm which includes a first cross joint, a second cross joint and an axle joint. A first pad link can be connected to a first pad secondary pivot and a second pad link can be connected to a second pad secondary pivot. The first pad link axle is connected to the base frame assembly, and the second pad link axle is connected to the base frame assembly. The crank assembly may also have a belt, and the crank assembly may also have a bidirectional retainer system for removing slack from the belt.

A first pad link can connect to a first pad secondary pivot and a second pad link can connect to a second pad secondary pivot. The first pad link axle is connected to the base frame assembly, and the second pad link axle is connected to the base frame assembly. The crank assembly further comprises a belt, and the crank assembly further comprises a bidirectional retainer system for removing slack from the belt. The first handle assembly can be connected to the crank assembly by a third link assembly, and the second handle assembly can be connected to the crank assembly by a fourth link assembly.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

The following call out list of elements can be a useful guide in referencing the elements of the drawings.

10 Cyclical Skating Motion Exercise Machine
20 Base Frame Assembly
22 Base Frame
24 First Pedal Pivot
26 Second Pedal Pivot
28 Crank Pivot
30 First Handle Pivot
32 Second Handle Pivot
34 Slot
40 First Pedal Assembly
42 First Pedal Arm
44 First Pedal Axle
46 First Pedal Joint Point
48 First Pedal Pad
50 First Pad Link
52 First Pad Link Axle
54 First Pad Secondary Pivot
56 First Pad Main Pivot
60 Second Pedal Assembly
62 Second Pedal Arm
64 Second Pedal Axle
66 Second Pedal Joint Point
68 Second Pedal Pad
70 Second Pad Link
72 Second Pad Link Axle
74 Second Pad Secondary Pivot
76 Second Pad Main Pivot
80 Crank Assembly
82 Crank Pulley
84 Crank Arm
86 First Crank Joint
88 Second Crank Joint
100 First Link Assembly
102 First Cross Joint
104 Second Cross Joint
106 Axial Joint
108 Bearing One
110 Bearing Two
112 Bearing One Axle
114 Bearing Two Axle
116 Bearing Three
117 Rod Mount
118 Flange Mount
119 Bearing Three Axle
120 Second Link Assembly
140 First Handle Assembly
142 First Handle Arm
144 First Handle Arm Pivot
146 First Handle Joint Point
148 First Handle Grip
160 Second Handle Assembly
162 Second Handle Arm
164 Second Handle Arm Pivot
166 Second Handle Joint Point
168 Second Handle Grip
180 Third Link Assembly
200 Fourth Link Assembly
220 Flywheel System
222 Wheel
224 Wheel Pulley
226 Second Belt
228 Second Wheel
230 Belt Tensioner
240 Bi-Directional Retainer System
242 First Wing
244 First Wing Axle
246 First Retainer Pulley
248 First Tension Member
252 Second Wing
254 Second Wing Axle
256 Second Retainer Pulley
258 Second Tension Member
260 Belt

DETAILED DESCRIPTION OF THE INVENTION

Figure 1:
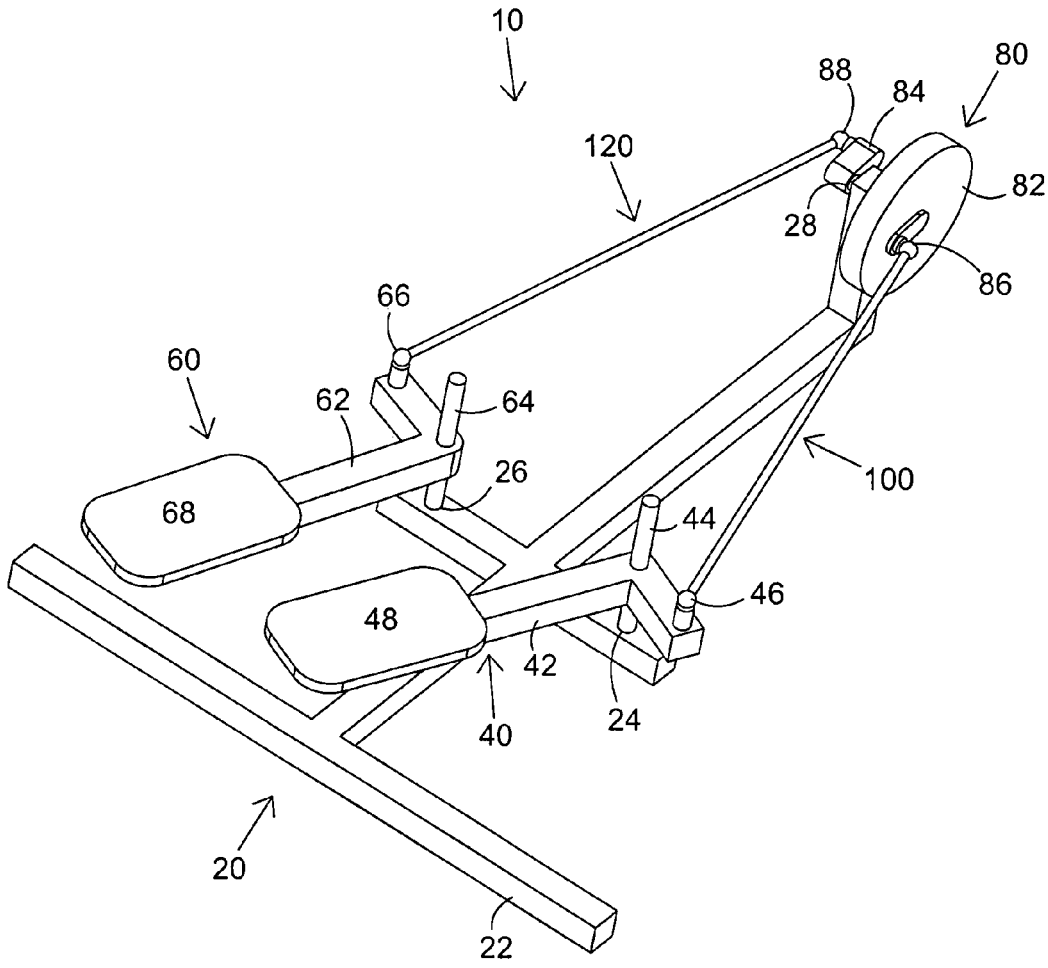
FIG. 1 is a perspective view of a first embodiment partly showing a structure frame for clarity.

The above described drawings FIGS. 1 through 9 illustrate the invention, a cyclical skating motion elliptical machine 10, comprising a base frame assembly 20, a first pedal assembly 40, a second pedal assembly 60, and a crank assembly 80 as shown in FIG. 1. Base frame assembly 20 structurally supports first pedal assembly 40, second pedal assembly 60, and crank assembly 80. Base frame assembly 20 comprises a base frame 22, that is a structure such as beams and flats joined together to provide proper positions for the moving parts, a first pedal pivot 24 on a first side and a second pedal pivot 26 on a second side such that the two pivots are a set distance apart from each other in the first embodiment shown in FIG. 1. Base frame assembly 20 further comprises a crank pivot at about equal distance away from both first pedal pivot 24 and second pedal pivot 26. Base frame 22 can be made of rods, flats, or tubes, and materials such as steel, aluminum, wood, or any other common material commercially available for structures.

First pedal assembly 40 comprises a first pedal arm 42 that provides a support structure for a first pedal axle 44, a first pedal joint point 46, and a first pedal pad 48. First pedal axle 44 is pivotally mounted on first pedal pivot 24 of base frame assembly 20. First pedal joint point 46 is placed at a set distance away from first pedal axle 44 so that first pedal arm 42 rotates about first pedal axle 44 when a force is applied on joint point 46. First pedal pad 48 is placed on first pedal arm 42 at a set distance away from first pedal axle 44 so that first pedal pad 48 moves toward the first side and back toward the second side when the force is applied on joint point 46. Second pedal assembly 60 comprises a second pedal arm 62 that provides a support structure for a second pedal axle 64, a second pedal joint point 66, and a second pedal pad 68. Second pedal axle 64 is pivotally mounted on second pedal pivot 26 of base frame assembly 20. Second pedal joint point 66 is placed at a set distance away from second pedal axle 64 so that second pedal arm 62 rotates about second pedal axle 64 when a force is applied on joint point 66. Second pedal pad 68 is placed on second pedal arm 62 at a set distance away from second pedal axle 64 so that second pedal pad 68 moves toward the first side and back toward the second side when the force is applied on joint point 66.

Figure 3:
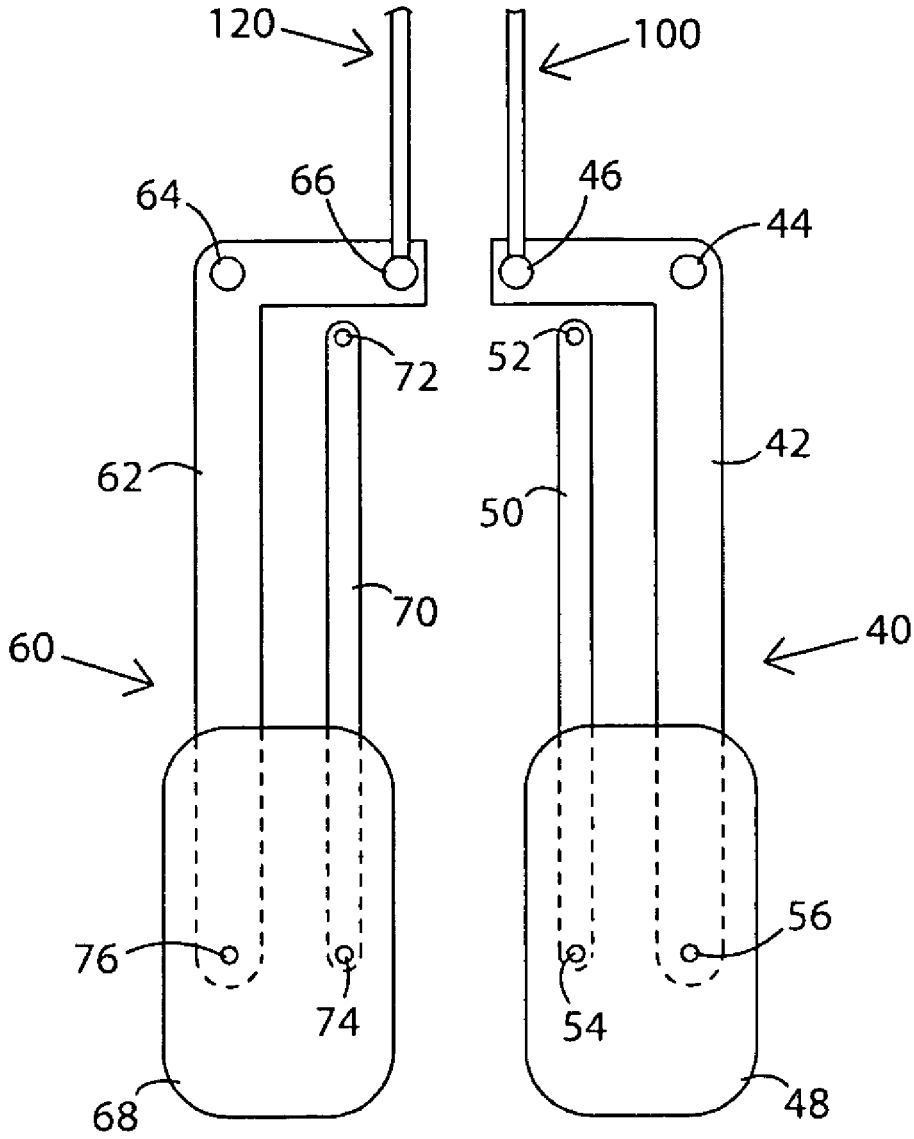
FIG. 3 is a plan view of a pedal arm system.

Each of pedal assemblies 40, 60 shown in FIG. 1 is representative of the structure and the design shown in FIG. 1 and other possible linkage systems comprising a pedal pad for a foot hold and a pedal joint point for linking with a crank system such as crank assembly 80. An example of more complex pedal assemblies is shown in FIG. 3 where first pedal pad 48 and second pedal pad 68 are pivotally mounted to first pedal arm 42 at a first pad main pivot 56 and second pedal arm 62 at a second pad main pivot 76 respectively. In order to guide the orientation of the pads through the motion range, a first pad link 50 and a second pad link 70 are introduced. A point on first pad link 50 is pivotally mounted on base frame assembly 20 at a first pad link axle 52 and a second point on link 50 is also pivotally mounted to pad 48 at a first pad secondary pivot 54. A point on second pad link 70 is pivotally mounted on base frame assembly 20 at a second pad link axle 72 and a second point on link 70 is also pivotally mounted to pad 68 at a second pad secondary pivot 74. This linkage system for the pedal assembly gives a control of the orientation of the pad through its motion profile but the basic side-to-side motion profile from the top view remains virtually the same. Other linkage systems for the pedal assembly are certainly possible. Also pedal axles 44, 64 can be universal joints or each being a two-axle joint allowing pedal pads 48, 68 move up or down as they move side ways. The up and down motion of the pedals then has to be controlled with either another set of linkage systems or a set of actuators such as shocks.

The first pedal axle is substantially vertical which means that it can be from about 45° angle to 120° angle from horizontal. Substantially orthogonal can be from about a 45° angle to 120° angle from perpendicular.

Crank assembly 80 is pivotally mounted at crank pivot 28 of base frame assembly 20. Crank assembly 80 comprises a crank pulley 82, a crank arm 84, a first crank joint 86, and a second crank joint 88. Crank pulley 82 can be a belt pulley for belts such as V-belts, flat belts, and round belts or a sprocket for a chain or even a gear with teeth so that crank pulley 82 can be mechanically linked with another rotational part such as a flywheel that turns faster than crank pulley 82. FIG. 1 shows crank arm 84, on the second side of base frame assembly 20, that supports second crank joint 88, and crank pulley 82, on the first side, that supports first crank joint 86 so that both crank joints rotate about crank pivot 28. First crank joint 86 and second crank joint 88 are about 180 degree offset in their angular positions centered at crank pivot 28. On the first side, crank pulley 82 acts also as a crank arm to support first crank joint 86. However, only one crank joint is required to operate the invention, which will be shown in another embodiment below, even though the first embodiment shown in FIG. 1 has two crank joints.

In the first embodiment, crank assembly 80 is mechanically linked to first pedal assembly 40 and second pedal assembly 60 with a first link assembly 100 and a second link assembly 120 respectively. One side of first link assembly 100 is pivotally connected to first crank joint 86 of crank assembly 80 and the other side of first link assembly 100 is also pivotally connected to first pedal joint point 46. And one side of second link assembly 120 is pivotally connected to second crank joint 88 and the other side of the assembly is also pivotally connected to second pedal joint point 66. Because the rotational axis of crank arm assembly 80 is not parallel with neither of the axes of the first and second pedal assemblies, both link assemblies must have three-dimensional rotation. Even if they are theoretically in the same rotational plane, in the real world it is very challenging to keep their axes exactly parallel to each other in a large size structure. A three-dimensional link assembly will naturally compensate the offset angle created between any two axes of the parts linked together.

Figure 10:
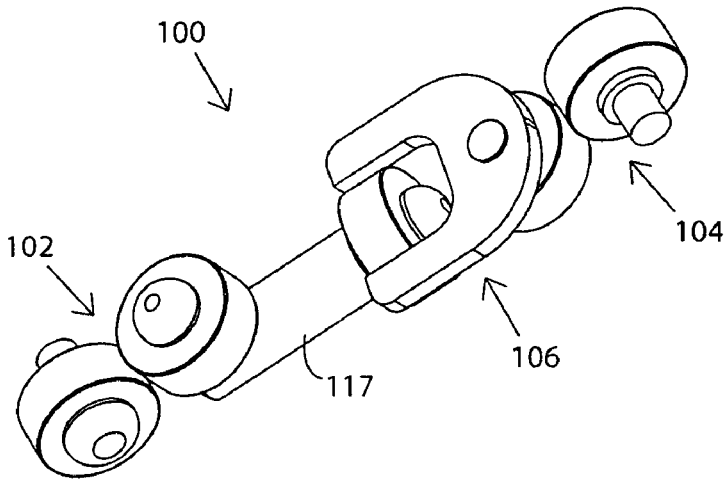
FIG. 10 is a perspective view of an example of a link assembly that connects the crank assembly to the pedal assemblies.
Figure 11:
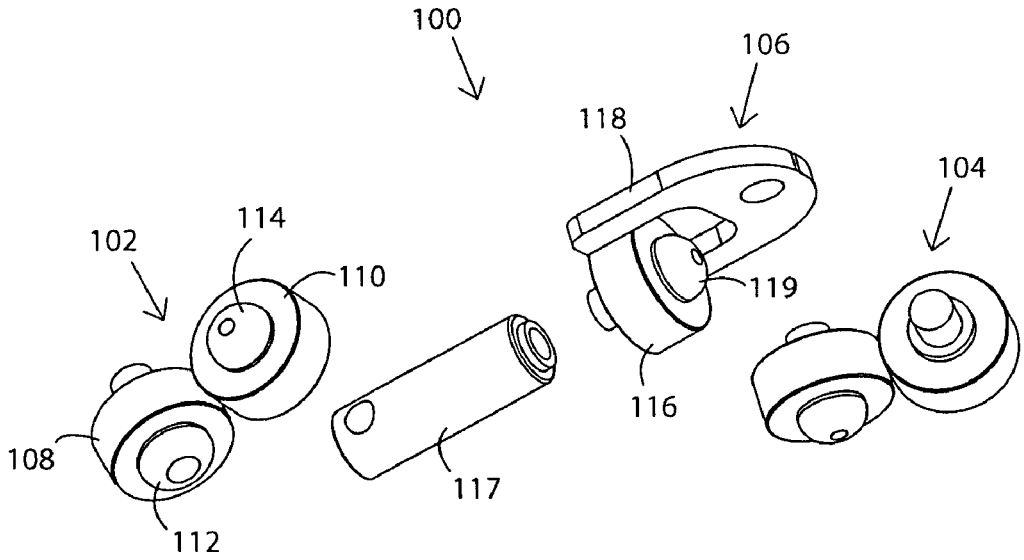
FIG. 11 is a perspective and exploded view of the link assembly.

First link assembly 100 and second link assembly 120 can basically be a rod and ball joints at each end connecting crank joints 86, 88 to pedal joint points 46, 66 respectively to allow three-dimensional rotation in the link assemblies 100, 120. However, the ball joints still have a limited range of movement because they have to be mounted with either a rod or a bolt going through the ball part. Also it is hard to seal the ball joints. Another way to create the three-dimensional rotation is using simple bearings that are sealed or shielded for durability. In FIGS. 10 and 11 show an example of such construction using simple bearings. In FIG. 11, link assembly 100 comprises a first cross joint 102, a second cross joint 104, an axle joint 106, and a rod mount 117. First cross joint 102 is basically two bearing embedded housings, a bearing one 108 and a bearing two 110, rigidly joined together with their axes of rotations offset about 90 degree from each other as shown in FIG. 11. Bearings could be a sleeve shaped bushing material or sealed or shielded ball bearings or roller bearings. Second cross joint 104 may share the same construction of first cross joint 102. Axle joint 106 comprises a bearing three 116 that is another bearing embedded housing and a flange mount 118 rigidly joined together so that flange mount 118 provides a mounting surface for the cross joint and the cross joint to rotate about an axis about 90 degree offset from the axis of bearing three 116 as shown in FIG. 11. Rod mount 117 is provided for mounting axle joint 106 axially through bearing three 116 at one end of rod mount 117 and a cross joint such as first cross joint 102 mounted on a side or at about 90 offset angle at the other end of the rod mount 117. The length of rod mount 117 can be varied depending on how long the link assembly has to be. And another link assembly can be mounted at a point along rod mount 117 for handle movement. A bearing one axle 112, a bearing two axle 114, and bearing three axle 119 are provided to pivotally mount bearing one 108, bearing two 110, and bearing three 116 respectively to a structural surface, and they can be bolts or shafts. Bearing three 116 of axle joint 106 is a crucial part in the link assembly since a little axial slack in the movement can be transmitted to the pedals when the force being transmitted changes its direction. Bearing three should be tight in axial direction by using ball bearings or double row angular ball or roller bearings. Other link assemblies in this application or similar type applications where the force being transmitted by the link assemblies change its direction frequently share the same construction of link assembly 100 shown in FIGS. 10 and 11 for smooth and tight movement of the pedals and handles and for the durability of the components. But for simplicity in construction, a rod with a ball joint at each end of the rod may also be used as the link assembly. Or a rod with a ball joint at one end of the rod and a cross joint such as first cross joint 102 shown in FIG. 11 at the other end of the rod may work, too, as a link assembly.

Figure 2:
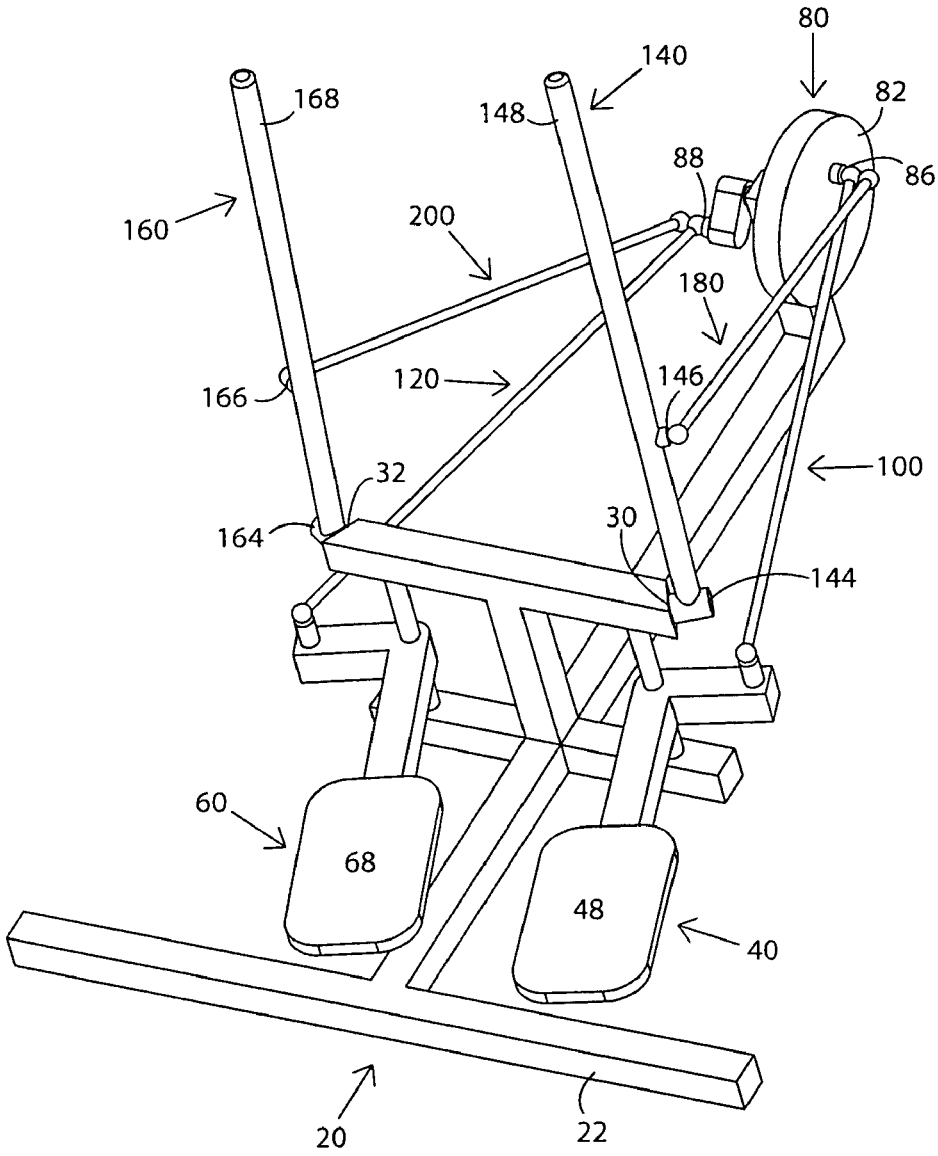
FIG. 2 is a perspective view of the first embodiment with moving handles.

There are many ways to provide moving handles linked with other moving parts in the invention. The handles could be on either side of a bar that has a rotational axis vertically on the centerline of the base assembly between the first side and the second side (not shown). FIG. 2 shows the invention with a first handle assembly 140 and a second handle assembly 160 mounted on base frame assembly 20 that also provides mounting points for the handle assemblies at a first handle pivot 30 and a second handle pivot 32 respectively. First handle assembly 140 comprises a first handle arm 142 extended from a first handle arm pivot 144, a first handle joint point 146 on first handle arm 142 at a set distance apart away from first handle arm pivot 144, and a first handle grip 148 near one end of first handle assembly 140. Second handle assembly 160 comprises a second handle arm 162 extended from a second handle arm pivot 164, a second handle joint point 166 on second handle arm 162 at a set distance apart away from second handle arm pivot 164, and a second handle grip 168 near one end of second handle assembly 160. Both handle assemblies are mounted at specific angles on the base frame and they are linked directly to crank assembly 80. First handle assembly is linked to crank assembly 80 with a third link assembly 180 and second handle assembly is linked to crank assembly 80 with a fourth link assembly 200 as shown in FIG. 2. Third link assembly 180 and fourth link assembly 200 provide three-dimensional rotation like the first and second link assemblies and they can be connected to any other moving parts including the first and second link assemblies to create the proper handle motion for a user. However the user may use the apparatus with her or his back toward the crank assembly, then the handle grips must be placed in front of the user by either shaping and extending the handle arm portion to the proper positions or relocating the mounting points on the base frame for the handle assemblies.

Figure 4:
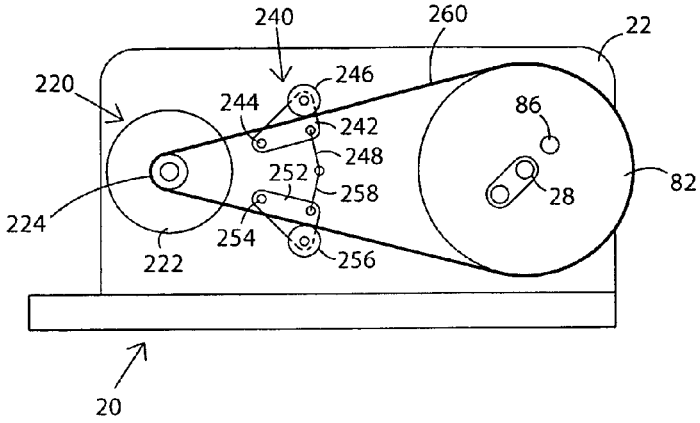
FIG. 4 is a plan view of a flywheel system.
Figure 5:
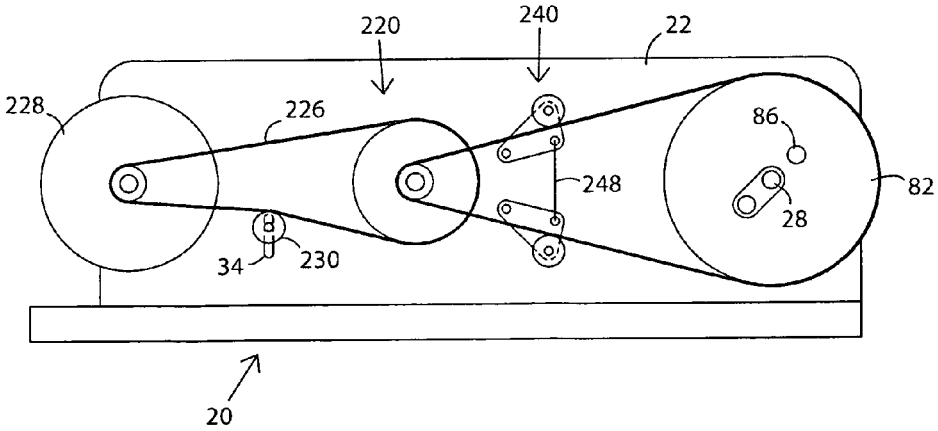
FIG. 5 is a plan view of another flywheel system.

Flywheel systems are shown in FIGS. 4 and 5 and can be used with the crank assembly. A flywheel system 220 is basically mounted on base frame assembly 20 with a wheel 222 being a first flywheel or a step pulley linked with the crank assembly by a belt 260. In FIG. 4, wheel 222 is a flywheel that turns faster than crank pulley 82 since a wheel pulley 224 rigidly mounted on wheel 222 is smaller in diameter than crank pulley 82. Belt 260 can be a V-belt, flat belt, a chain, or any other flexible loop that can transfer a force from one wheel to another. Some belts may stretch momentarily when a large amount of force shift its direction in the belts when they are moving with the pulleys. That happens when a large flywheel is used and/or a high rotation ratio is applied between the crank pulley and the flywheel in this type of exercise equipment on which the user has a heavy body weight, or start and stop the apparatus quickly. The user initiates the rotation of the crank and the flywheel but when the user slows down her or his motion then the flywheel starts to carry the user's weight through the motion profile. This happens especially when the user switches the direction of the motion in the middle of the motion profile or at each end of the motion profile where the pedals switch their direction. Usually a belt tensioner is forced against the belt often close to the belt's tension limit to keep the belt in the pulley grooves as shown in FIG. 5 on a second belt 226, but this method has a limitation and the belt wears out quickly from the high tension and rubbing on the pulley grooves.

A good solution is a bi-directional retainer system 240 is used to relief the stress on the belt and keep the belt in the grooves or on the pulley surface securely at all the time for longevity. Bi-directional retainer system 240 comprises a first wing 242, a second wing 252, and at least one tension member such as a spring or a rubber cord. First wing 242 is pivotally mounted on base frame 22 at a first wing axle 244, and at a set distance away on the wing, a first retainer pulley 246 is mounted to push the belt on one side. Second wing 252 is pivotally mounted on base frame 22 at a second wing axle 254, and at a set distance away, a second retainer pulley 256 is mounted on second wing 252 to push the belt on the other side. FIG. 4 shows a first tension member 248 and a second tension member 258 mounted on base frame 22 and pulling first wing 242 and second wing 252 respectively. In FIG. 5, only one tension member is used directly between the wings to pull them to each other. The tension in the belt created by the wings and retainer pulleys 246, 256 can be and is small once the primary belt tension is properly set. The tension members 248, 258 can be weak springs or rubber cords only to give a slight push on the belt. This will make the belt last a long period for this type of applications where the force direction in the belt changes frequently. The contact point of retainer pulleys 246, 256 can be anywhere along the belt with its portion not in contact with crank pulley 82 to push the belt into the groove of wheel pulley 224. FIG. 5 further shows a second wheel 228 as a flywheel that is connected to wheel 222 that is a primary flywheel and a step pulley in this case. Second belt 226 that connects both flywheels is tensioned by a belt tensioner 230 on one side, that is mounted on a slot 34 on base frame 22 to show a simple and well-known way to tension a belt. Either one of wheels 222, 228 or both may be equipped with a friction system that allows the user to adjust the resistance force in the flywheel system.

The connection between the pulleys and the wheels can also be gears instead of flexible loops such as belts or chains. In fact, the pulleys and the wheels themselves can have gear teeth to engaged to each other directly. While gears may work and last long time in a proper setting, they are noisy and costly for an application in which the force direction shifts frequently.

To use the apparatus, the user gets onto the two pedal pads on her or his feet and pushes the pedals to either of side directions. Then crank assembly 80 starts to rotate whether clockwise or counterclockwise. Since crank assembly 80 is linked with the flywheel system, the inertia from the flywheel helps the crank assembly maintain its initial rotational direction as the user pushes the pedals side to side. As the pedals move side to side, each handle also moves in a reciprocating manner because it is linked with the crank assembly or with any other moving parts. The user may push or pull the handles to assist the crank assembly maintain its initial rotational direction. The handle arms being linked with either the crank assembly directly or to first link assembly 100 and second link assembly 120 is useful not just for the user's arm workout, but also for the crank assembly to overcome its dead zone. When the crank assembly is linked with the pedal assemblies only as shown in FIG. 1, there are at least two angular positions, the dead zone, of the crank assembly that the direction of all the forces line up at both first crank joint 86 and second crank joint 88, leaving no net force applied on them. This makes the apparatus hard to start at those angles. For this reason, the handle assemblies can be linked to either the crank assembly or first and second link assemblies 100, 120 in an angle that gives a net force on the crank joints at the dead zone, causing the crank assembly to start rotating. FIG. 2 shows one example of the handles linked to the crank assembly to help the user to start the apparatus at any angular position of the crank assembly when he or she uses the pedals and the handles.

Figure 6:
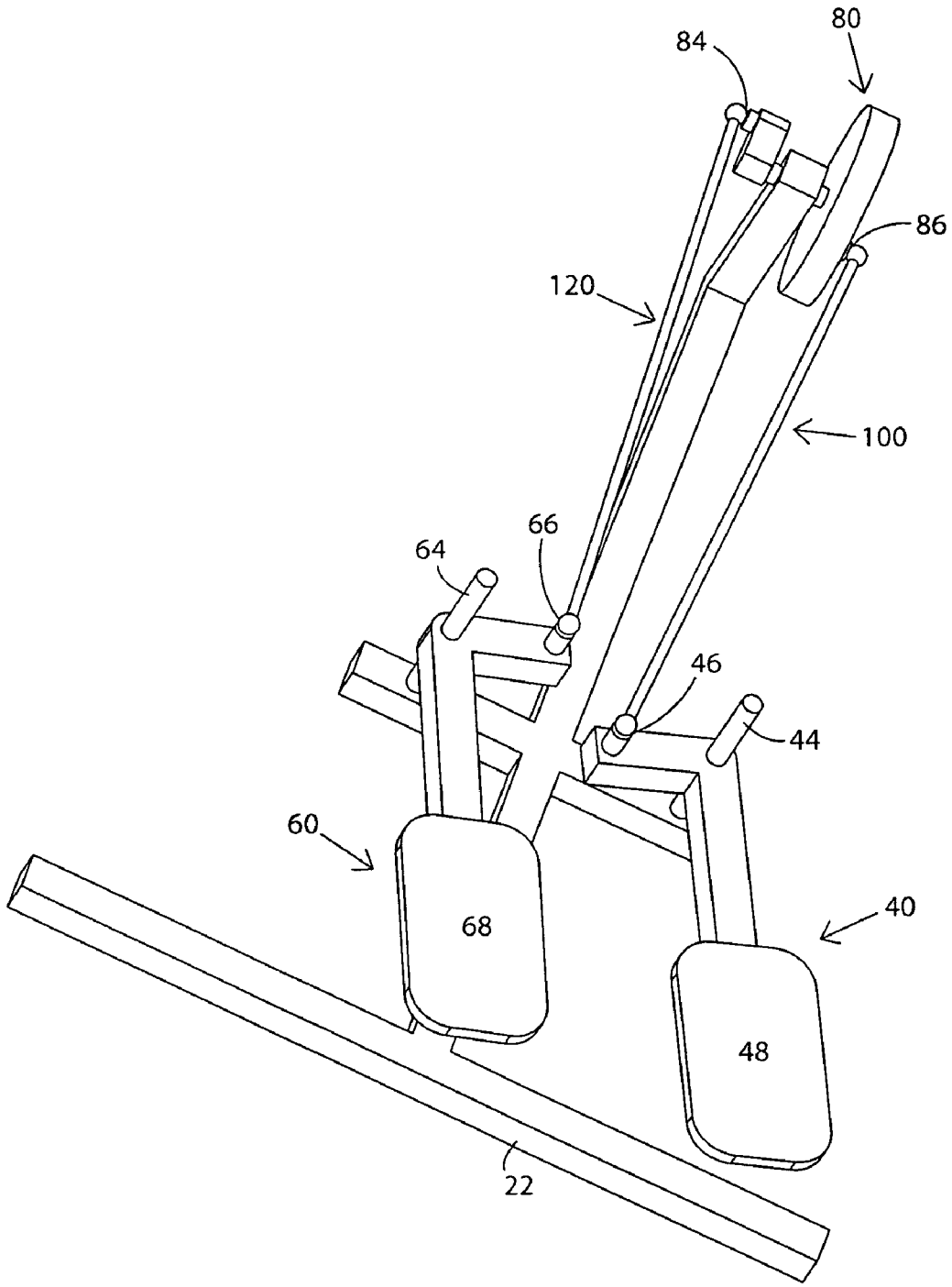
FIG. 6 is a perspective view of a second embodiment showing another possible position of joint point on the pedal arm system.
Figure 7:
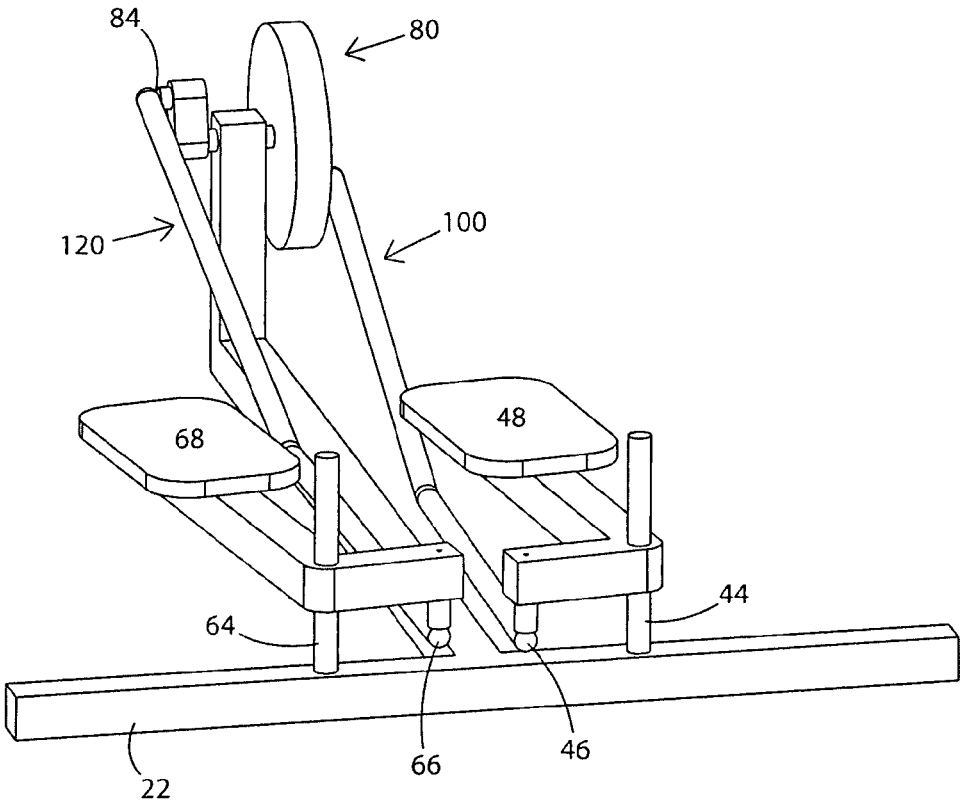
FIG. 7 is a perspective view of a third embodiment showing another possible orientation of pedal arm systems.
Figure 8:
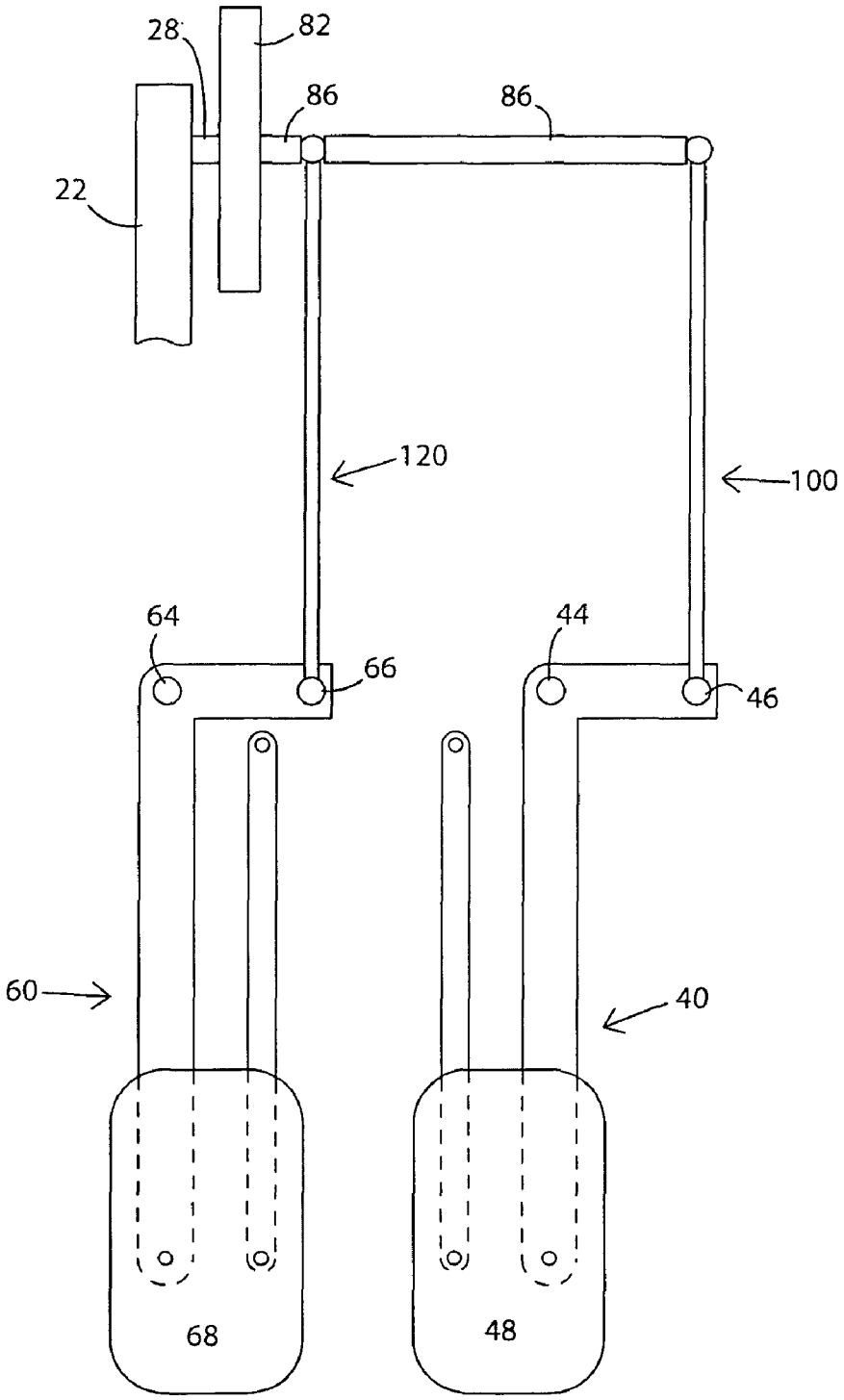
FIG. 8 is a plan and top view of fourth embodiment showing two pedal assemblies are linked to one joint point on the crank assembly.
Figure 9:
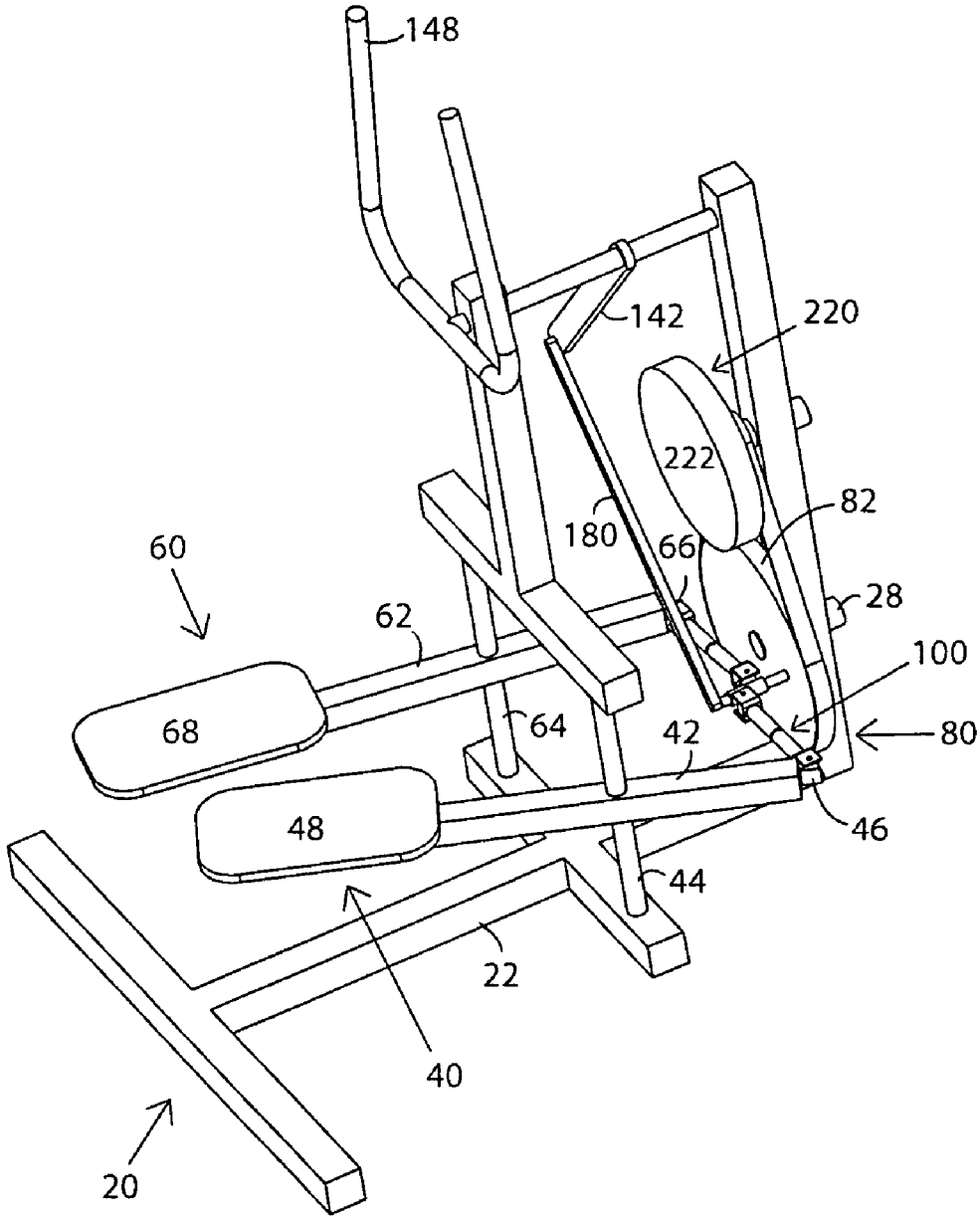
FIG. 9 is a perspective view of fifth embodiment showing a different orientation of the crank assembly that gives virtually the same movement of the pedals.

FIGS. 6 and 7 show slightly different ways to connect the pedal assemblies to the crank assembly. In FIG. 6, first pedal joint point 46 and second pedal joint point 66 are placed between first pedal axle 44 and second pedal axle 64, giving virtually the same workout movement of the pedals. Another possibility is shown in FIG. 7 with first pedal pad 48 and second pedal pad 68 being between the crank assembly and pedal axles 44, 64. Pedal joint points 46, 66 may be either in between first pedal axle 44 and second pedal axle 64 or on the outer sides of pedal axles 44, 64 as shown in FIG. 1. FIG. 8 shows an embodiment with both first link assembly 100 and second link assembly 120 linked to first crank joint 86. This arrangement shown in FIG. 8 also produces virtually the same movement of the pedal arms shown in other embodiments. FIG. 9 shows an embodiment very similar to the one shown in FIG. 8 and another type of handles that share one pivot point. Link assembly 180 can be a simple link with a single axis pivot at each end if the handle pivot and the axle of the crank assembly are near perfectly parallel. As explained above, link assembly 180 can be attached at crank joint 86 or anywhere along either link assemblies 100, 120. It has both first and second link assemblies 100, 120 linked to first and second pedal assemblies 40, 60 respectively and both link assemblies 100, 120 linked to first crank joint 86 of crank assembly 80 with its rotational axis is turned about 90 degree from the embodiments shown in FIGS. 1, 6, 7, and 8. All the embodiments shown in the figures including FIG. 9 have the crank assembly with its rotational axis about 90 degree offset from the rotational axes of the pedal assemblies. This makes the pedal assemblies move from one side to the other and vise versa in a symmetric manner or nearly a symmetric manner depending on how close the components are put together in the real world compared to an idealized lines and points in a drawing. Symmetrical ski or skating motion means that the curve of the speed of pedals moving from one side to the other side at angular positions of the pedals is mirror-imaged with that of the pedals moving in the opposite direction when the crank assembly, linked with the pedals, is at a set rotational speed. In other words, symmetric movement of the pedal assemblies can be observed here when their speed at a given angular position from the first far end is equal to their speed at the same angular position from the second far end when the pedals are moving in the opposite direction and the crank assembly is turning at a set rotational speed so that the user may feel the motion is balanced. The offset angle between the crank assembly and the pedal assemblies may be more or less than 90 degrees or orthogonal, that may make the pedal movement slightly not symmetrical. A perfect symmetrical motion is achieved when the axis of the crank is orthogonal to the axes of the pedals and the axes of the pedals are in parallel. However, in the real world, the user may not notice the movement of the pedals being slightly off from the perfect symmetrical motion for the relevant axes slightly off from being orthogonal from each other or the axes of the pedal assemblies not being parallel, slightly angled from each other.

Other possible embodiments not shown are different ways of linking the crank assembly and the pedal assemblies using the link assemblies. At least one link assembly needs to be connected to the crank assembly directly whether the link assembly is directly or indirectly linked to at least one pedal assembly. The first and second pedal assemblies can be then linked directly together using another link assembly. The link assembly connecting the two pedal assemblies or connecting the crank assembly to the pedal assemblies can be a simple link with a single axle pivot at each end whenever the two mounting points that the link connects have axle lines that are parallel throughout the motion range. All the embodiments shown here may be used as their front side, the side the user is facing, being toward the crank assembly or toward the opposite direction of the crank assembly. Pedal assemblies 40, 60 shown FIGS. 1, 2, 6, 7, and 9 are representations of any linkage system that includes a pedal pad for the user to step on and is linked with a crank system or the crank assembly that maintains its initial rotational direction for a non-interrupted exercise routine or workout session. An example of such pedal system is shown in FIG. 3. Also it is possible that pedal axles 44, 64 are angled to give pedal pads 48, 68 some vertical displacement as they move side ways to make the workout more dynamic.

Although the invention has been disclosed in detail with reference only to the above embodiments, those skilled in the art will appreciate that various other embodiments can be provided without departing from the scope of the invention. Accordingly, the invention is defined only by the claims set forth below.

The invention claimed is:

1. A cyclical skating motion exercise machine comprising:

a base frame assembly;

a first pedal arm mounted on a first pedal axle, wherein the first pedal axle is substantially vertical, and wherein the first pedal axle is fixed to the base frame assembly;

a first link assembly mounted to the first pedal arm at a first pedal joint point, wherein the first pedal joint point provides motion between the first link assembly and the first pedal arm;

a first pedal mounted to the first pedal arm for supporting a user's foot;

a second pedal arm mounted on a second pedal axle, wherein the second pedal axle is substantially vertical, and wherein the second pedal axle is fixed to the base frame assembly;

a crank assembly, wherein the first link assembly is mounted to the crank assembly, wherein the crank assembly has rotational inertia about an axis that is substantially orthogonally to the first pedal axle;

a first crank joint continuously rotating about a crank pivot when the first crank joint is in use; and a second crank joint continuously rotating about the crank pivot when the second crank joint is in use, wherein the first and second pedal axles are fixed directly to the base frame.

2. The cyclical skating motion exercise machine of claim 1, further comprising: a first handle assembly, and a second handle assembly, the first handle assembly connected to the crank assembly by a third link assembly, and the second handle assembly connected to the crank assembly by a fourth link assembly, wherein the first handle assembly, and the second handle assembly are directly mounted to the frame at a set distance apart.

3. The cyclical skating motion exercise machine of claim 1, further comprising:

a first handle grip pivotally connected to the crank assembly via a first crank arm and a third link assembly.

4. The cyclical skating motion exercise machine of claim 1, wherein the first link mounted to the first pedal arm comprises a first cross joint, a second cross joint and an axle joint, further comprising: a first handle grip pivotally connected to the crank assembly via a first crank arm and a third link assembly.

5. The cyclical skating motion exercise machine of claim 1, wherein the first link assembly mounted to the first pedal arm comprises a first cross joint, a second cross joint and an axle joint, further comprising: a first handle grip pivotally connected to the crank assembly via a first crank arm and a third link assembly, further comprising a first pad link connected to a first pad secondary pivot and a second pad link connected to a second pad secondary pivot, wherein the first pad link axle is connected to the base frame assembly, wherein the second pad link axle is connected to the base frame assembly, wherein the crank assembly further comprises a belt, and wherein the crank assembly further comprises a bidirectional retainer system for removing slack from the belt.

6. The cyclical skating motion exercise machine of claim 1, wherein the first link assembly mounted to the first pedal arm comprises a first cross joint, a second cross joint and an axle joint.

7. The cyclical skating motion exercise machine of claim 1, further comprising a first pad link connected to a first pad secondary pivot and a second pad link connected to a second pad secondary pivot, wherein the first pad link axle is connected to the base frame assembly, wherein the second pad link axle is connected to the base frame assembly.

8. The cyclical skating motion exercise machine of claim 1, wherein the crank assembly further comprises a belt, and wherein the crank assembly further comprises a bidirectional retainer system for removing slack from the belt.

9. The cyclical skating motion exercise machine of claim 1, further comprising a first pad link connected to a first pad secondary pivot and a second pad link connected to a second pad secondary pivot, wherein the first pad link axle is connected to the base frame assembly, wherein the second pad link axle is connected to the base frame assembly, wherein the crank assembly further comprises a belt, and wherein the crank assembly further comprises a bidirectional retainer system for removing slack from the belt.

10. The cyclical skating motion exercise machine of claim 1, further comprising:

a first handle assembly, and a second handle assembly, the first handle assembly connected to the crank assembly by a third link assembly, and the second handle assembly connected to the crank assembly by a fourth link assembly.

11. The cyclical skating motion exercise machine of claim 10, wherein the first link assembly mounted to the first pedal arm comprises a first cross joint, a second cross joint and an axle joint.

12. The cyclical skating motion exercise machine of claim 10, further comprising a first pad link connected to a first pad secondary pivot and a second pad link connected to a second pad secondary pivot, wherein the first pad link axle is connected to the base frame assembly, wherein the second pad link axle is connected to the base frame assembly.

13. The cyclical skating motion exercise machine of claim 10, wherein the first link assembly mounted to the first pedal arm comprises a first cross joint, a second cross joint and an axle joint, further comprising a first pad link connected to a first pad secondary pivot and a second pad link connected to a second pad secondary pivot, wherein the first pad link axle is connected to the base frame assembly, wherein the second pad link axle is connected to the base frame assembly, wherein the crank assembly further comprises a belt, and wherein the crank assembly further comprises a bidirectional retainer system for removing slack from the belt.

* * * * *